US007692170B2

(12) United States Patent
Gaus et al.

(10) Patent No.: US 7,692,170 B2
(45) Date of Patent: Apr. 6, 2010

(54) RADIATION APPARATUS

(75) Inventors: Rainer Gaus, Gmund (DE); Wolfgang Mohr, Halstenbek (DE); Guenther Gesell, Stephanskirchen (DE); Thomas Klingenberg, Norderstedt (DE)

(73) Assignee: Advanced Photonics Technologies AG, Bruckmuehl (DE)

( * ) Notice: Subject to any disclaimer, the term of this patent is extended or adjusted under 35 U.S.C. 154(b) by 377 days.

(21) Appl. No.: 11/579,256

(22) PCT Filed: May 4, 2005

(86) PCT No.: PCT/EP2005/004888

§ 371 (c)(1),
(2), (4) Date: Feb. 12, 2007

(87) PCT Pub. No.: WO2005/105448

PCT Pub. Date: Nov. 10, 2005

(65) Prior Publication Data

US 2007/0214986 A1 Sep. 20, 2007

(30) Foreign Application Priority Data

May 4, 2005 (DE) ..... 10 2004 021 845

(51) Int. Cl.
*B41F 23/04* (2006.01)

(52) U.S. Cl. ..... 250/504 R; 250/453.11; 250/454.11; 250/455.11; 250/492.1; 118/620; 427/457; 427/487

(58) Field of Classification Search ..... 250/453.11, 250/454.11, 455.11, 492.1, 504 R; 118/620; 427/457, 487

See application file for complete search history.

(56) References Cited

U.S. PATENT DOCUMENTS 4,005,135 A * 1/1977 Helding ..... 422/186.3
4,019,062 A 4/1977 Rongren
4,048,490 A 9/1977 Troue
4,644,899 A 2/1987 Glaus
4,864,145 A 9/1989 Burgio, Jr.

FOREIGN PATENT DOCUMENTS

DE 43 01 718 A1 7/1994
DE 102 43 577 A1 4/2004
DE 10243577 * 4/2004
DE 103 33 664 A1 2/2005
GB 1 489 183 10/1973

OTHER PUBLICATIONS

"UV- und Inert-UV-Technologie für den Offsetdruckprozess." *Schwerpunkt*. Nr. 34, Oct. 21, 2004, pp. 46-47.

* cited by examiner

*Primary Examiner*—David A Vanore
*Assistant Examiner*—Michael Maskell
(74) *Attorney, Agent, or Firm*—Dennison, Schultz & MacDonald; George H. Spencer

(57) ABSTRACT

Disclosed is a radiation apparatus for technical uses, especially a UV crosslinking apparatus of a printing press, coating machine, or similar. Said radiation apparatus comprises at least one radiation source emitting a processing radiation, at least one controllable and particularly wavelength-selective reflector which is assigned to the radiation source and is used for selectively directing the processing radiation onto a substrate that is to be processed or away therefrom, a driving mechanism which is effectively connected to the reflector, and a housing accommodating at least the at least one radiation source and the at least one reflector. At least one first and second radiation source are provided between which the controllable reflector is disposed and which can be operated above all in a separate manner. The reflector is formed and mounted so as to direct the processing radiation of all radiation sources towards the substrate in a first position while directing the processing radiation of all radiation sources away from the substrate in a second position.

37 Claims, 8 Drawing Sheets

Figure 3:
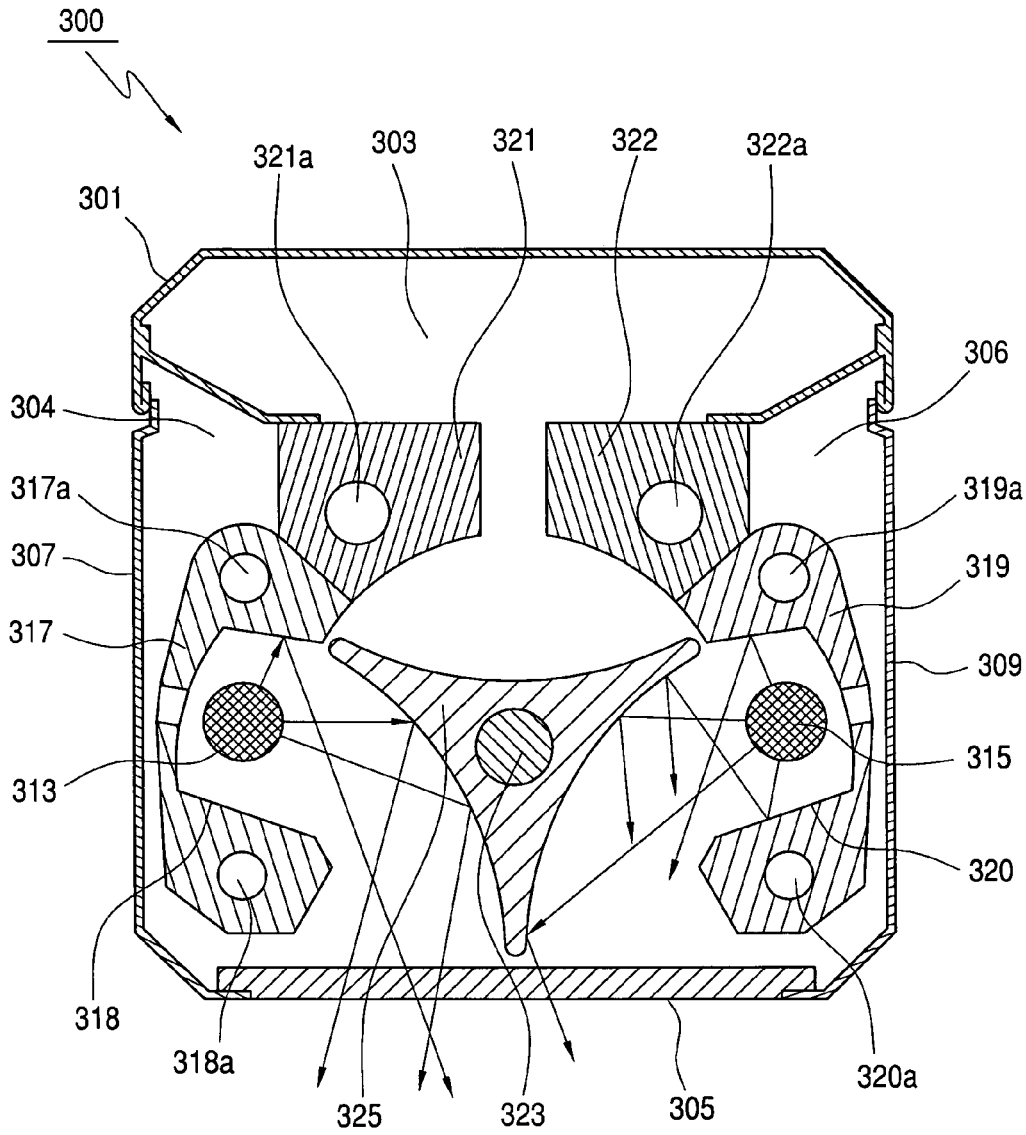

FIG. 1
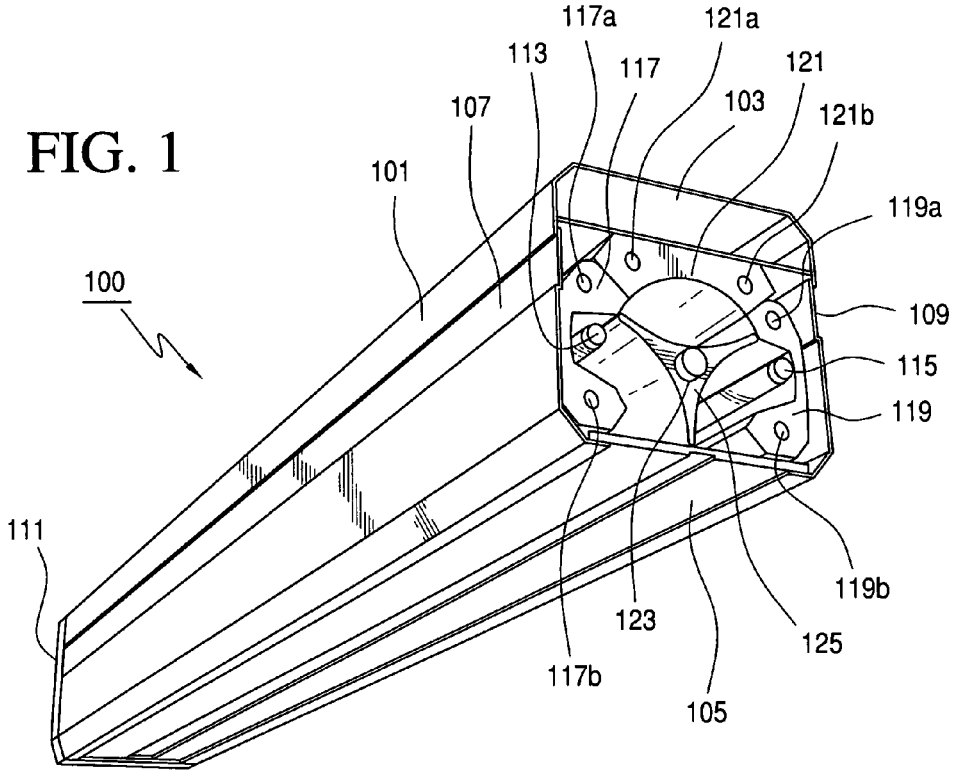
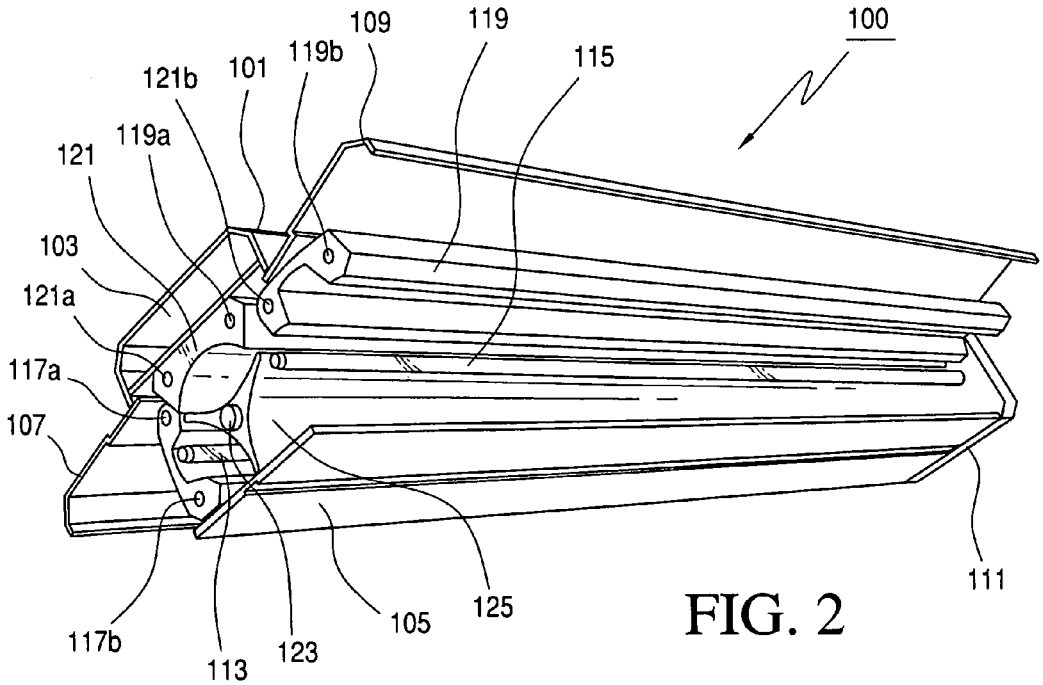
FIG. 2

RADIATION APPARATUS

The invention concerns an irradiating apparatus according to the generic definition of claim 1 and uses of such an apparatus.

Irradiating apparatus of this kind or of a similar type are known from the state of the art.

Thus, U.S. Pat. No. 4,019,062 describes a technical UV radiation unit with short-arc UV lamps, paraboloid reflectors each neighboring them and a rotary concave-spherical reflector that focuses the UV radiation on a pre-adjustable surface of a substrate to be treated.

A fixture for UV polymerization of coating materials is known from U.S. Pat. No. 4,644,899 that comprises a partially permeable, rotating mirror that allows IR radiation components of the UV radiation source through and causes them to meet up with a cooling facility, whereas the UV components actively used for processing are reflected and guided onto the surface of a substrate running through under the irradiating apparatus.

A similar irradiating apparatus is also described in detail in U.S. Pat. No. 4,864,145.

DE 102 43 577 Al also shows and describes a similar UV irradiating apparatus in which adjustment of the controllable reflector to a deactivation position parallel or perpendicular to the radiation impact face of the (in particular parabolic) reflector allocated directly to the radiation source is provided for.

From DE 103 33 664 Al an apparatus for hardening of substances on a substrate is known that also comprises essential characteristics of such an irradiating apparatus and in which in particular reflectors are provided whose surface pointing towards the UV radiation source has different optical characteristics to a surface pointing towards a supporting element. The supporting construction of the housing is preferably made of an aluminum extruded profile and the reflectors are in particular bolted onto an actively cooled supporting element.

These known irradiating apparatus do not fully exploit the potential of the underlying principle of operation.

The invention is therefore based on the object of providing an improved, in particular fast and effectively controllable, irradiating apparatus of the generic type that has a long useful life and which can also be manufactured rationally and at low cost.

This task is resolved in relatively independent variants of the concept of the invention by irradiating apparatus with the characteristics of claims 1, 10, 19 and 23. Expedient enhancements of the invention's concept in its diverse independent variants are the subject of the dependent claims.

According to a first aspect of the invention, the proposed irradiating apparatus comprises two—preferably similar—radiation sources whose processing radiation is routed through a common, central controllable reflector in the operating state onto the substrate to be processed, while the same reflector in a deactivated position keeps the radiation of both radiation sources away from the substrate. Contrary to known irradiating apparatus, the proposed solution offers considerably improved flexibility in relation to adjustment to specific powers ranging from approximately 15 W/cm to approximately 240 W/cm. When a suitable reflector geometry is used, for many processing purposes the interplay of two radiation sources results in an optimum ratio between the intensity and energy distribution on the substrate to be processed (in particular if it is to be cross-linked or hardened). Thanks to the geometry of the controllable reflector (tilted mirror), the radiation profile can be varied easily within a width range without other components of the irradiating apparatus necessarily also having to be varied.

Together with the reduction of the radiation sources' radiation output that is usual in the event of deactivation, use of the controllable reflector as a shutter enables standby operation for a practically unlimited time.

In a preferred variant of the invention, it is planned for the radiation sources, the controllable reflector and the housing to be stretched out like a profile. It is also planned for the controllable reflector and/or the auxiliary reflectors and/or the end reflector portions to have a curved reflector surface. It is understood that, with a suitable curvature, especially of the partly parabolic or partly elliptical type, an essentially linear radiation source can be favorably mapped onto a large-area workpiece.

In a preferred variant of the invention, it is also planned to arrange precisely two radiation sources of the same type on both sides of a mirror-symmetrical controllable reflector. In this variant, it is particularly easy to pre-define the radiation field created on the substrate. If the two radiation sources can be controlled separately, in applications that required the output of only one radiation source, the result is a duplicated production deployment time of the irradiating apparatus.

In another preferred variant of the invention, it is planned for the controllable reflector to be rotatable between the first and second positions and for the driving mechanism to comprise a, particularly electric motor or pneumatic, rotary actuator. This version results in a particularly compact design, which is especially advantageous in applications with a small available installation space, for example in the case of printing presses.

In a further variant of the invention, it is planned to arrange at least one stretched out, in particular wavelength-selective auxiliary reflector each in the angle range around the radiation sources that is not taken up by reflector surfaces of the controllable reflector, which essentially guides processing radiation towards the controllable reflector. If these auxiliary reflectors are made wavelength-selective in such a way that their reflection capacity for the actual processing radiation is higher than the radiation components not serving the purpose of processing, in particular undesirable thermal radiation, the thermal load on a sensitive substrate can furthermore be reduced. However, for reasons of optimum energy utilization of the radiation generated, a version that is not wavelength-selective may also offer substantial advantages.

In a particularly energy-efficient and also maintenance-friendly variant of the invention, it is planned for one top and bottom auxiliary reflector each to be placed in the spaces above and below the first or second radiation sources, whose cross-section in particular comprises a non-isosceles approximate U-shape.

In a further preferred variant of the invention, it is planned for one end reflector portion to be allocated to the ends of each radiation source. As a result, on the one hand an optimized geometry of the radiation field generated on the substrate is achieved, especially in the radiation source's end zones, and, on the other hand, a higher energy efficiency is achieved.

In an expedient variant of the invention, it is planned for the controllable reflector and/or auxiliary reflectors and/or the end reflector portions to each have at least one coolant duct to pass through a coolant fluid. In most large engineering applications, radiation sources with such a high output are used that active cooling of the components subjected to the most radiation is necessary, if only for reasons of useful life. For many cases, liquid cooling is planned for this purpose, with the result that coolant ducts must be dimensioned for a liquid coolant and the ports must be realized accordingly.

According to a second relatively independent aspect of the invention, it is proposed for the controllable reflector to have at least one removable reflector surface inserted in the supporting structure. This makes it easily possible, for diverse specific geometric configurations, to use a small number of types of supporting elements and nevertheless cover a large number of applications by the use of differently shaped reflector surfaces.

In a first expedient enhancement of this aspect of the invention, it is planned for the one, or each, radiation source to be allocated one stationary auxiliary reflector which also has at least one separably inserted reflector surface that essentially guides the processing radiation towards the controllable reflector. The combination of controllable reflector and auxiliary reflector(s) with equally variably selectable reflector surfaces offers particularly high variability in relation to the realization of required radiation density distributions and other radiation parameters.

In expedient versions, the separately manufactured reflector surfaces inserted in supporting elements are metal plates with a curvature defined by shaping and/or curvature adjusted in the inserted state and optionally suitable (possibly different) coatings of the front and/or rear sides. For example, glass reflectors with reflecting and in particular selectively reflecting or dichroitic coating can be alternatively used.

In a further expedient enhancement it is planned for the one, or each, supporting element to comprise an extruded or continuously cast profile, in particular consisting of aluminum or an aluminum alloy. In a further expedient enhancement it is planned for the one, or each, reflector surface to be held by a latching or snap fastener in the respective supporting element.

A preferred version of both aforementioned invention concepts provides for the controllable reflector to be split in the longitudinal direction, wherein at least one first and second part can be moved independently of one another in such a way that, during operation of the apparatus, only one of them is in the first position, but the other is in the second position. This makes it possible in an extremely easy and efficient way to realize a so-called "format deactivation" in printing presses in which printed matter of differing widths is printed. The advantage of such an adaptation is that, thanks to the radiation direction, radiation is introduced into the processing system (e.g. printing press) only to the extent actually required and unnecessary heating up of machine sections not covered with a workpiece is avoided.

In a first variant, this version is designed so that a driver acting dependent on the direction of motion is provided for between the first and second parts of the controllable reflector which, however, drives the second part only in one direction of motion together with the first, but does not drive it in another direction of motion. In this case, in particular the first and second parts are capable of rotating on a common shaft and the driver operates as a function of the direction of rotation.

In another variant, this enhancement is designed such that the first and second parts are held on a common hollow shaft and can be driven separately via it or a separate power transmission element accommodated in it.

According to a further relatively independent aspect of the invention, the one or each radiation source is allocated at least one auxiliary reflector that can be tilted or moved to a maintenance position. This can in particular also constitute a housing part—that is in the sense of this variant, but is not imperative. In any case, the respective radiation source becomes accessible by tilting down or moving the auxiliary reflector and can be easily replaced or, if necessary, also cleaned.

According to a first preferred version, the auxiliary reflector is designed and held so that the radiation source becomes accessible to an adequate extent by tilting it down or moving it. In an alternative version, it is planned for the one, or each, radiation source to be allocated two auxiliary reflectors that each constitute a housing part and can be tilted or moved and for these to be designed and held so that the radiation source becomes accessible to an adequate extent by tilting it down or moving it.

One common feature of both versions is that the one, or each, auxiliary reflector capable of tilting or moving is expediently held by a latching or snap fastener on a stationary part of the housing in the operating position.

According to a further relatively independent version of the invention, an actively cooled radiation absorber is arranged in each radiation direction of the controllable reflector in which the processing radiation is guided away from the substrate. This arrangement is used to avoid situations in which, although reduced in intensity in the event of deactivation, the radiation still has a considerable intensity and is emitted from the corresponding system, which is already risky for health and safety reasons, but also because of possible thermal damage to neighboring system parts.

In this case, in particular the radiation absorber comprises a coolant fluid duct whose surface pointing towards the controllable reflector has a high capacity for absorbing the radiation of the radiation source(s). In particular, it is intended for the coolant fluid duct of the radiation absorber to be realized and dimensioned as a cooling air duct.

In an expedient design variant, the coolant fluid duct (with a correspondingly stable wall) is designed such that it constitutes the mechanical supporting element for the entire irradiating apparatus. Then, in particular, at least part of the auxiliary reflectors is mounted on it in a manner that permits tilting or movement, and also the mount and contact element for the radiation sources is fitted in the area of the coolant fluid duct. Moreover, the coolant fluid duct, especially in its configuration as an air duct, can accommodate the drive of the controllable reflector including electronic control, electrical supply leads and measuring or monitoring elements as well as their signal leads.

For realization of the aforementioned supporting and supply duct function, one termination or head plate featuring complex engineering design is planned at the ends of the absorber system to realize the mechanical connection of the components to each other, connection of the individual coolant fluid ducts, the pivot points for swiveling or tilting components and the mount and contact points for the radiation sources.

On the outside of these termination plates, adapters for mechanical fastening of the irradiating apparatus in an overall system and the necessary supply and disposal connections (air, if necessary water, high voltage, exhaust air, and control and monitoring lines) are attached. Also at least part of the auxiliary reflectors or absorbers is held in an expedient engineering design in such a way as to rotate between the head plates. In this case, a cooling water supply is simultaneously realized.

The versions mentioned below can be used in more or less advantageous ways in all versions of the invention explained above:

In particular the one, or each, radiation source is a medium or high-pressure UV radiation source. It is preferably intended for the wavelength-selective controllable reflector and/or auxiliary reflector to have a high reflection coefficient in the UV range and a substantially lower reflection coefficient in the IR range. Other kinds of wavelength selectivity are basically potentially significant—for special applications; however, considering the aforementioned aspect of largely keeping heat radiation away as far as possible in many UV drying/cross-linking processes, this UV/IR selectivity is of particular importance. In a way that is known per se, this can be realized by coating the reflector surface(s) with a dichroitic layer.

In conjunction with the aspect, mentioned further above, of structuring at least one part of the reflectors out of a supporting element and reflector surfaces (especially separably) inserted in it, the result is a version in which the surface of at least part of the reflector surfaces pointing away from the radiation source and pointing towards the supporting element has a high IR emission capacity and/or is in good thermal conduction contact with the supporting element in such a way that a substantial part of arriving IR radiation components is dissipated into the respective reflector interior.

In the interests of a long service life of the costly radiation sources, it is also preferred that the one, or each, radiation source is forcibly cooled by cooling air blown into the housing and/or sucked out of it. In combination with the radiation absorber construction with a cooling air duct, it is planned for the cooling air duct of the radiation absorber to have openings for an exchange of air with the area surrounding the radiation source(s).

According to a further continuation of the aforementioned concept of the invention, the side pointing towards the substrate is essentially sealed by a protective shield that is permeable for the processing radiation, but in particular reflects and/or absorbs wavelength-selectively. In particular, in this case the protective shield has a low reflection and absorption coefficient in the UV range and a substantially higher reflection and/or absorption coefficient in the IR range. Here also, other kinds of wavelength selectivity may be of practical significance and may be feasible (with already familiar means). However, especially for so-called inertised systems the use of a non-selective protective shield is also possible, which then simultaneously serves to separate the irradiating apparatus and the inter chamber.

Figure 4:
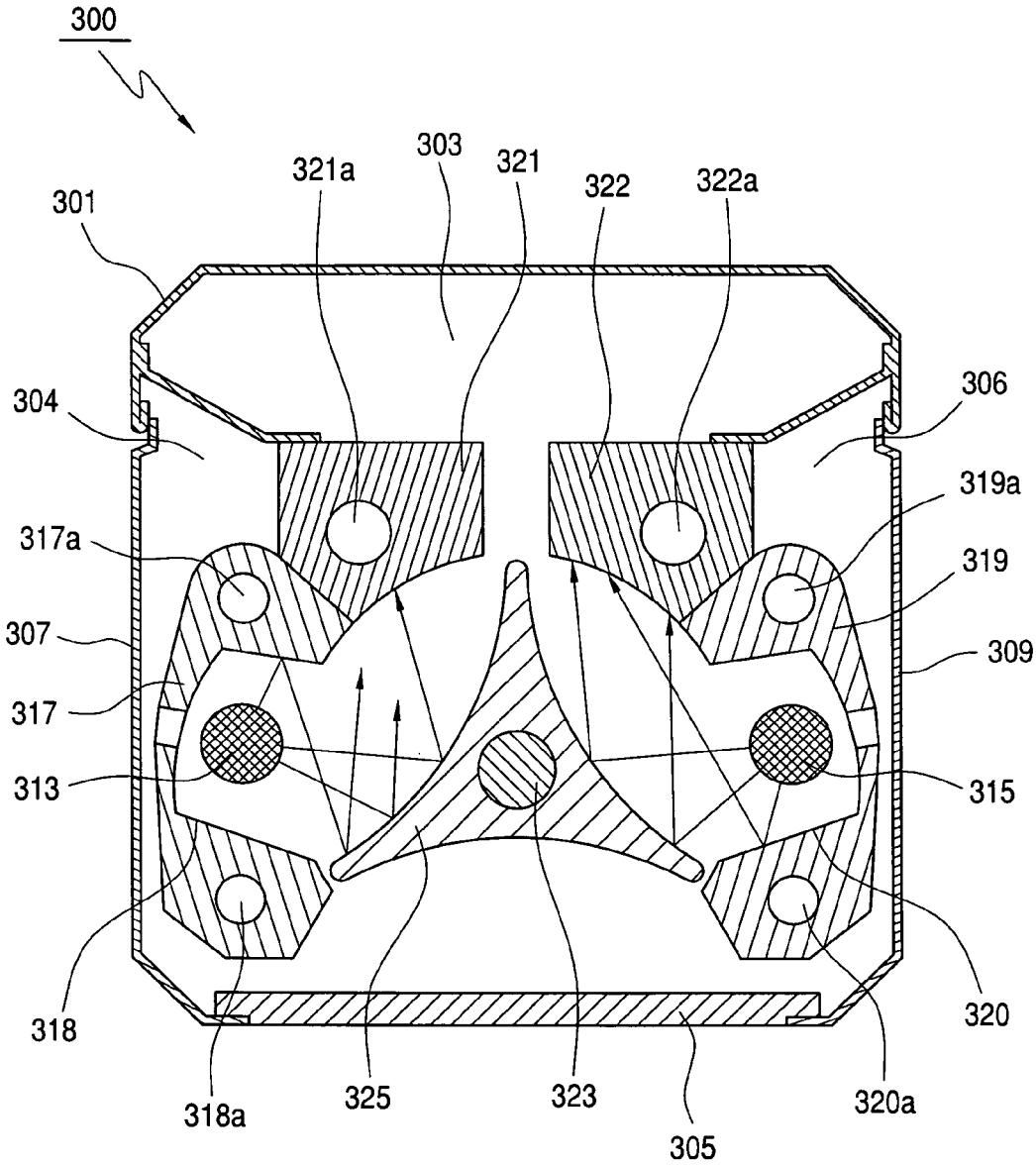
Figure 5:
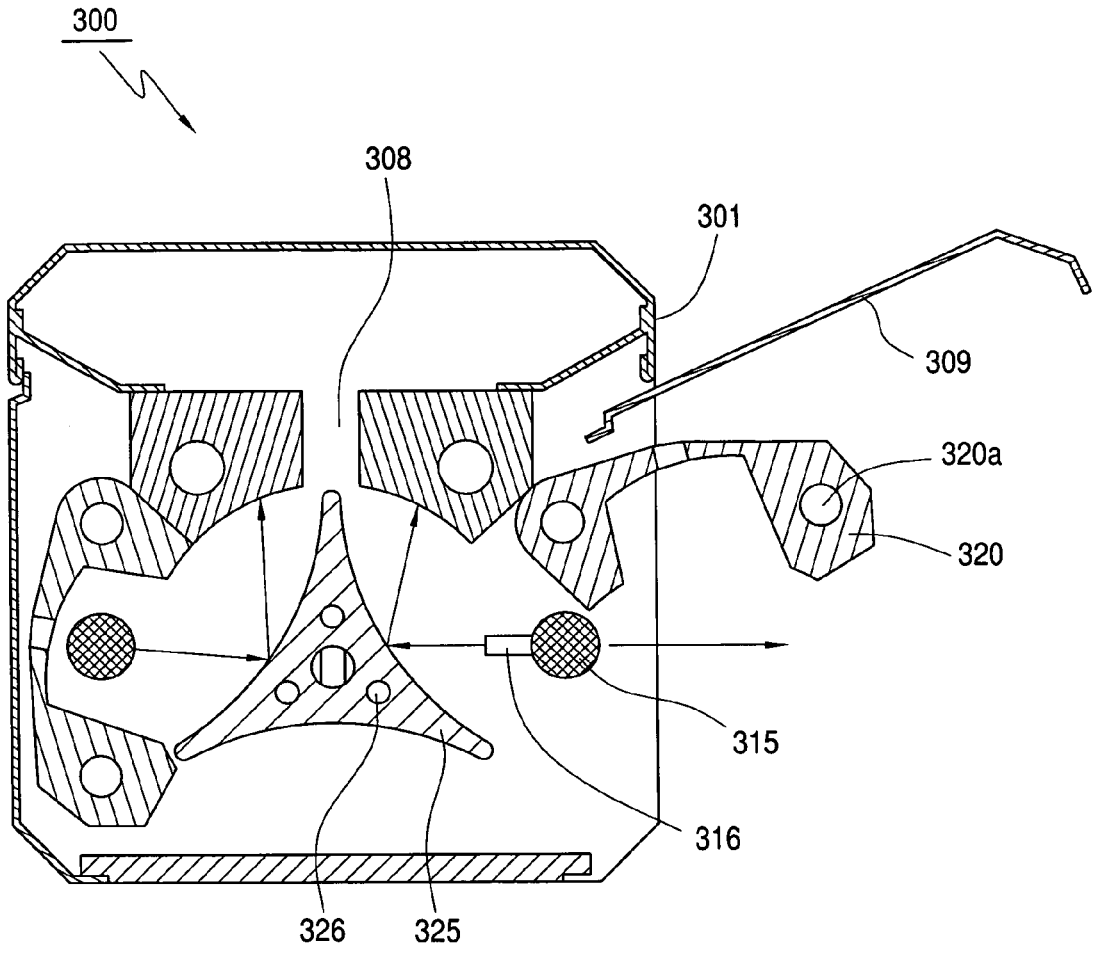
Figure 6A:
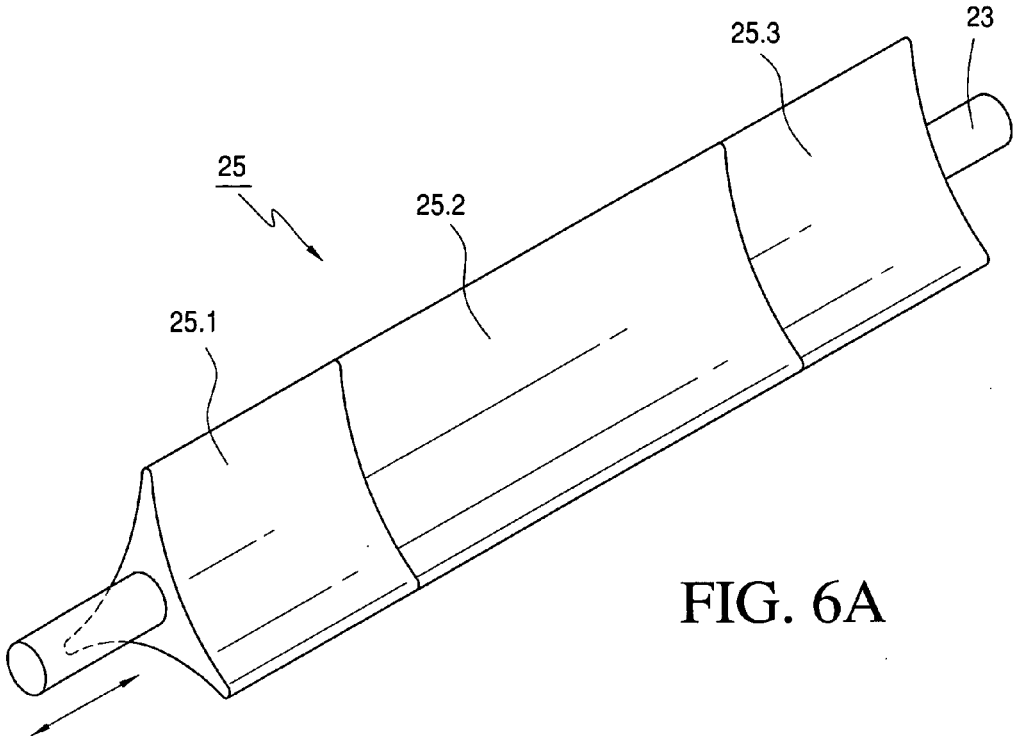
Figure 6B:
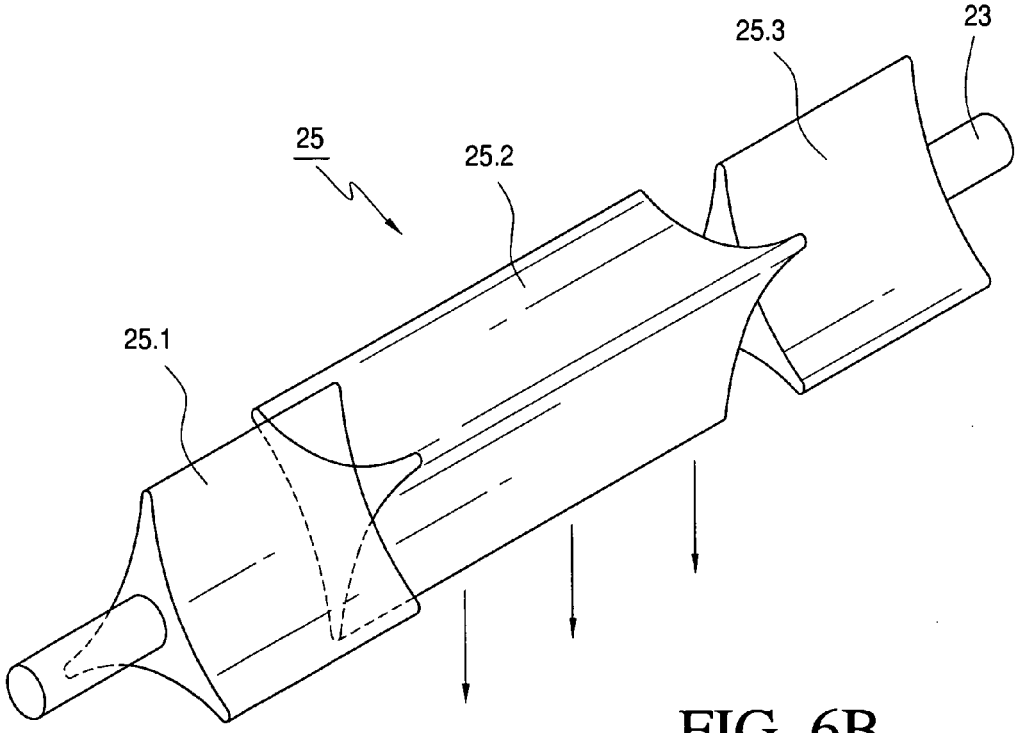
Figure 7:
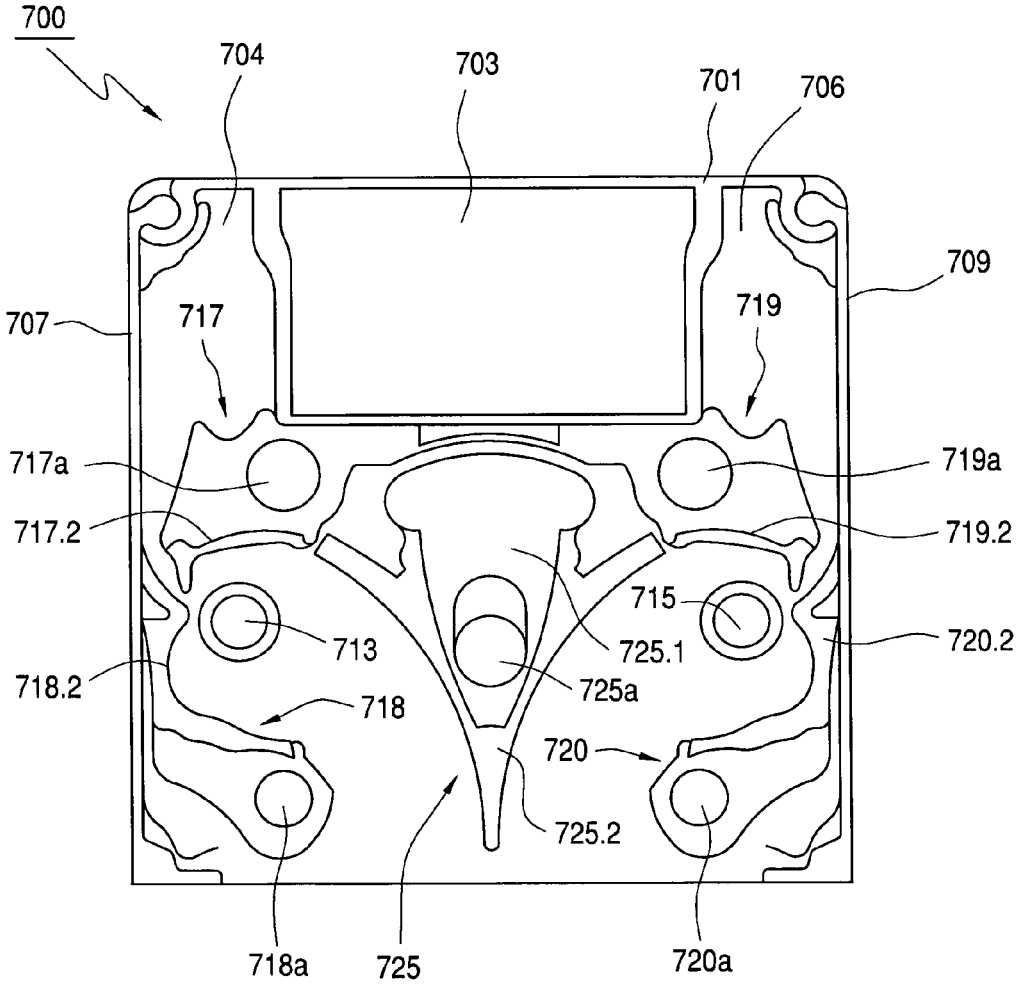
Figure 8:
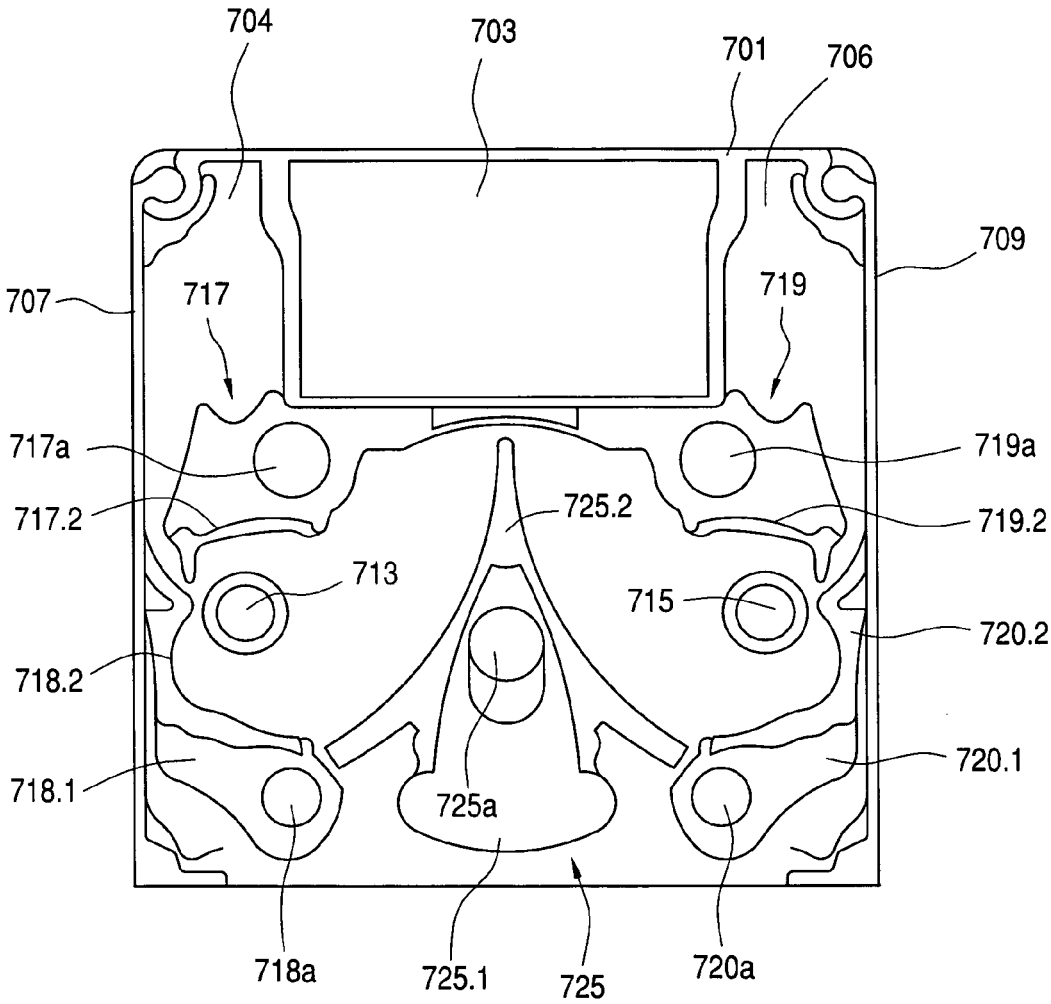
Figure 9:
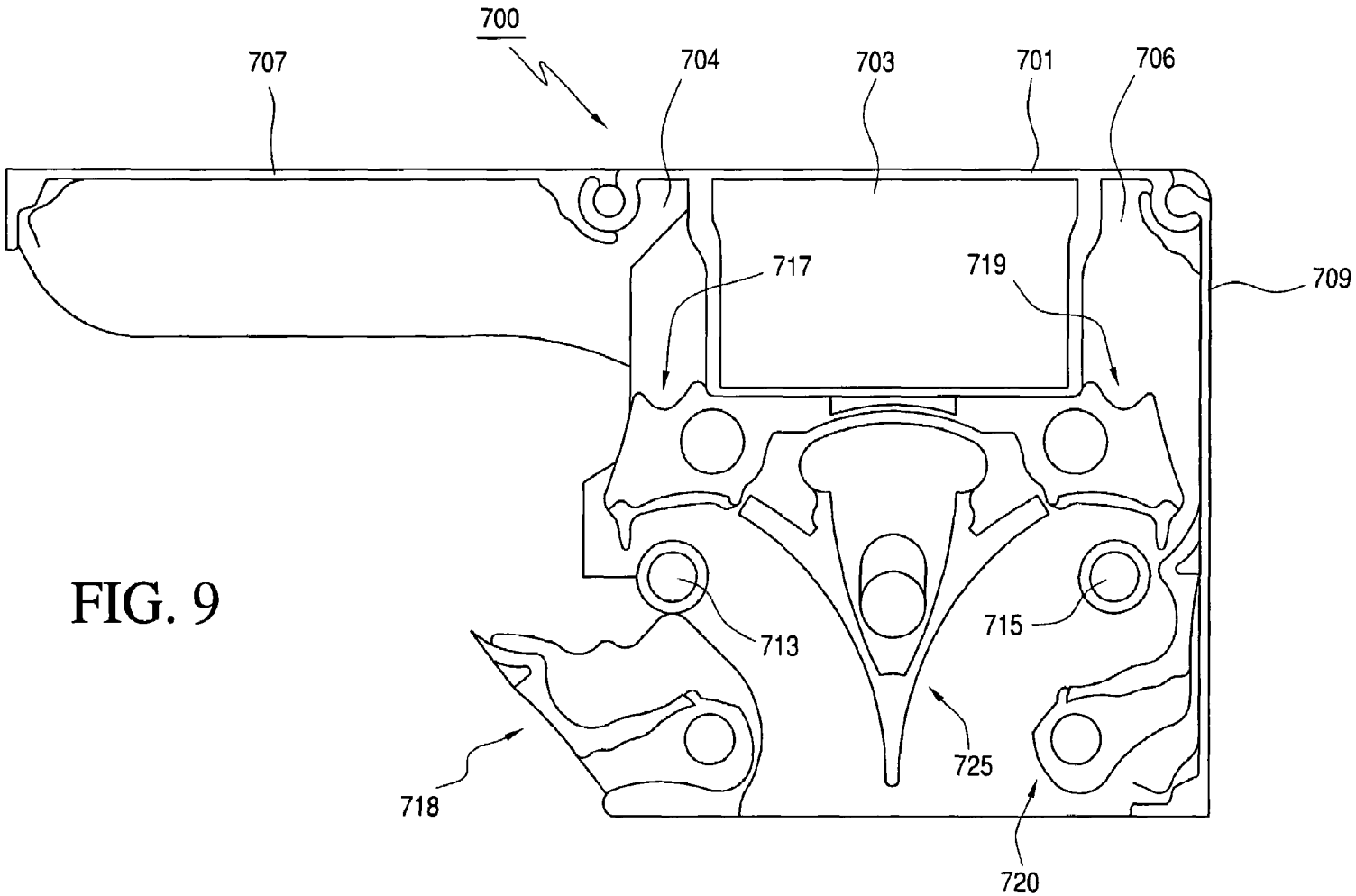

Advantages and practicalities of the invention otherwise result from the dependent claims and the following description of preferred variants with reference to the figures. Of these:

FIG. 1 shows a perspective view of an irradiating apparatus according to one of a first version of the invention in the closed state (with the front head plate detached), FIG. 2 shows a perspective view of the irradiating apparatus from FIG. 1 after opening for maintenance, from another viewing angle, FIG. 3 shows a schematic cross-section of an irradiating apparatus according to a second version of the invention in the operating state, FIG. 4 shows a schematic cross-section of the irradiating apparatus according to FIG. 3 in the deactivated state, FIG. 5 shows a schematic cross-section of the irradiating apparatus according to FIG. 3 in the unilaterally opened state for replacement of a radiation source, FIGS. 6A and 6B show equivalent diagrams (perspective view) of a preferred version of the controllable reflector of the irradiating apparatus according to FIG. 1 or FIG. 3, FIG. 7 shows a schematic cross-section of an irradiating apparatus according to a third version of the invention in the operating state, FIG. 8 shows a schematic cross-section of the irradiating apparatus according to FIG. 7 in the deactivated state and FIG. 9 shows a schematic cross-section of the irradiating apparatus according to FIG. 7 in the unilaterally opened state for replacement of a radiation source, FIGS. 1 and 2 show a UV irradiating apparatus 100 for use in a printing press for hardening printing inks in two perspective views, namely in FIG. 1 in the operating state and in FIG. 2 in a maintenance position.

As can be easily seen in FIG. 1, the irradiating apparatus 100 has a housing 101 in the basic form of a square prism with beveled corners.

In the top area of the housing 101 in the operating state, a cooling air duct 103 extending over the entire width of the irradiating apparatus 100 is intended. Towards the underside, the UV irradiating apparatus is limited by a UV-permeable protective shield 105 that essentially takes in the entire underside of the housing. As can be seen in FIG. 2, the housing 101 comprises two tilting side walls 107 and 109 which, just like the protective shield 105 extend over the entire length of the housing. On the face side, the housing 101 is terminated by head plates, of which only the rear one is depicted.

As radiation sources, the irradiating apparatus 100 has two identical-type, stretched out tubular UV radiation sources 113, 115, which extend in the longitudinal direction of the irradiating apparatus, in parallel with the housing walls. The UV radiation sources 113, 115, are suitably held and contacted in the area of the head plates 111 which, however, is not shown in the equivalent sketches of FIGS. 1 and 2. Both UV radiation sources 113, 115, are each allocated identically shaped auxiliary or primary reflectors 117, 119, which embrace clearly more than 180° of the radiation sources and whose reflector surfaces pointing towards the radiation sources (not separately marked) are essentially trough-shaped.

As can be seen clearly in FIG. 2, the auxiliary reflectors 117, 119 can tilt via a rotation shaft located in the top area of the housing 111 in a way similar to that of the housing side walls 107, 109 so that the associated UV radiation source becomes freely accessible from the housing side and can be replaced easily. Above and below the respectively allocated radiation source 113 or 115, each of the auxiliary reflectors has one coolant fluid duct 117*a*, 117*b* or 119*a*, 119*b* for passing through cooling water, with which heat introduced into the auxiliary reflectors by the radiation sources 113, 115 can be dissipated. In the version shown, the auxiliary reflectors 117, 119 are made of aluminum extruded profile.

A further aluminum extruded profile 121 is fitted on the bottom boundary wall of the cooling air duct 103, in close thermal contact with it, which also comprises two coolant fluid ducts 121*a*, 121*b* and whose function is explained further below. While the upper side of this extruded profile 121 is flat, corresponding to the shape of the bottom boundary of the cooling air duct, its underside in the cross-section is shaped concavely in the form of a circular segment.

In the middle between the UV radiation sources 113, 115, a rotating reflector 125 is in the basic shape of an equilateral prism with concavely shaped side walls is planned on a rotating shaft 123. In the position shown in FIG. 1, this rotating reflector 125 reflect the directly arriving radiation and also the radiation of the UV radiation sources 113, 115 deflected via the auxiliary reflectors 117, 119 towards the underside of the irradiating apparatus 100, and thus through the protective shield 105 to a workpiece (not shown) or substrate below it. As can be seen in FIG. 1, the shape of the auxiliary reflectors 117, 119 is such that the rotating reflector 125 can rotate freely between them and they simultaneously largely suppress the direct impact of radiation from the radiation sources 113,115 on the workpiece. The rotating reflector 125 is also an aluminum extruded part.

Distinct wavelength selectivity (dichroism) of the auxiliary reflectors and of the rotating reflector can be achieved—in a way that is known per se—by coating the reflecting surfaces or by inserting suitable dichroitic surface elements.

The described arrangement of the UV radiation sources, primary or auxiliary reflectors and the controllable reflector (in the position shown in FIG. 1) ensures that the majority of the IR radiation emitted by the radiation sources 113, 115 beside the required IR radiation first meets up with the cooled surfaces of the auxiliary reflectors, where it is absorbed and can be dissipated. By means of internal cooling (for example, to be realized by means of a hollow rotating shaft 123) of the rotating reflector, the heat introduced into it by the IR radiation can also be dissipated.

In total, by means of this structure, it is possible to ensure that a substantial part of the heat radiation is removed before the processing radiation passes through the protective shield 105 and cannot cause any damage to the substrate or any coating existing there. Additional filtering—also linked, however, with a loss of processing radiation—can be achieved by means of a selectively reflecting/absorbing realization of the protective shield, in which case the UV components are largely allowed to pass through, but IR components (and possibly also visible components) are partly reflected back to the rotating reflector and the auxiliary reflectors or are absorbed in the shield material.

To enable adequate dissipation of the heat also gathering in the space between the UV radiation sources and reflectors, active air cooling (not shown) is also planned in the bottom part of the housing of the irradiating apparatus.

An essential feature of the arrangement shown here is that the rotating reflector 125 not only serves to deflect the radiation of the radiation sources 113, 115 onto a substrate, but—but in another rotated position—also to keep this radiation way from the substrate and to deflect it to the radiation absorber 121, from where the heat is ultimately dissipated via the cooling air duct 103. For an explanation of this function, reference is made to the following description of FIG. 3 to 5, which show a modified version.

In schematic cross-sections, on the one hand these FIGS. 3 to 5 show the operating state (FIG. 3) and the partly opened state for maintenance purposes (FIG. 5) of this modified UV irradiating apparatus 300. However, they also show (in FIG. 4) a deactivated state in which the radiation sources are operated with reduced output and in which exposure of the workpiece with the remaining radiation output is therefore to be prevented.

The basic structure of the irradiating apparatus 300 is similar to that of the irradiating apparatus 100 according to FIGS. 1 and 2 and so general notes from the description above need not be repeated. Incidentally, the designations of essential parts of the apparatus with reference numbers have been adapted to those of the first version.

While the basic shape and the structure of the housing 301 agree with those of the first version, the bottom boundary of the cooling air duct 303 is not flat, but convex and, instead of a single-piece absorber element, here there are two radiation absorbers 321 and 322, each of which has one single coolant fluid duct 321*a* or 322*a*. Here, the auxiliary reflectors consist of two parts and each comprise one top and bottom auxiliary reflector 317, 318 or 319, 320 allocated to the UV radiation sources 323 and 325. Each of the auxiliary reflectors 317 to 320 has one single coolant fluid duct 317*a* to 320*a*.

In the FIGS. 3 and 4, the course of the radiation is sketched by way of example with arrows. It can be seen that, in the operating position according to FIG. 3 (i.e. when the shutter is open), the radiation of the radiation sources is essentially guided to the underside of the irradiating apparatus and through the protective shield by single or multiple radiation, while in the deactivated position shown in FIG. 4 the radiation is essentially guided to the absorber elements 321, 322 and is kept away from the underside of the irradiating apparatus. The maintenance position shown in FIG. 5 essentially corresponds to the state of the irradiating apparatus' right-hand housing side wall according to the first version in FIG. 2. It can be seen that the auxiliary reflectors 319, 320 are linked to one another and can be jointly tilted away upwards from the associated radiation source 325. The arrow pointing from the radiation source to the right symbolizes a radiation source replacement.

In this realization example, the two-part realization of the radiation absorber facilitates integrated cooling air guidance within the entire housing of the irradiating apparatus, possibly in combination with the so-called blown air and sucked air principle, i.e. production of an air exchange by feeding in or sucking off air under pressure. In this sense, the clearance between the radiation absorbers 321 and 322 acts as a cooling air connecting duct. Incidentally, lateral air ducts 304, 306 serve to pass through cooling air on the side walls of the housing 301 and thus to additionally dissipate heat from the auxiliary reflectors and directly from the radiation sources.

In FIG. 5, only a part of the components or areas of the irradiating apparatus 300 is/are marked with reference numbers and, in addition to FIGS. 3 and 4, a contact mount 316 of the radiation source 315 and, in the interior of the rotating reflector 325, three coolant fluid ducts 326 are shown.

FIGS. 6A and 6B show, in the form of equivalent sketches, as a special version of the rotating reflector explained further above, a segmented rotating reflector 25 on a rotating shaft 23. This reflector 25 has three sections 25.1, 25.2 and 25.3 with the same cross-sectional shape that are placed in a row in the longitudinal direction, of which the middle part 25.2 rotates separately from the front and rear parts 25.1 and 25.3 (which are linked to one another rotationally).

The "format deactivation" mentioned further above can be realized with this reflector version: If application of processing radiation from the entire length of the respective radiation sources (not depicted here) is required for a wide workpiece, all parts of the reflector are rotated from the deactivated position sketched in FIG. 6A to the operating position. If, however, a workpiece with less width (for example a print substrate) is to be radiated ("smaller format"), the fixed-rotation link between reflector parts is resolved and—as shown in FIG. 6B—only the middle part 25.2 is turned to the operating position. Therefore, no radiation is emitted from the edge zone of the irradiating apparatus because the front and rear parts of the rotating reflector 25 are still in the deactivated position.

Based on the depictions in FIGS. 3 to 5—operating position, deactivated position and maintenance position—in a cross-section FIG. 7 to 9 show, as a further version, a UV irradiating apparatus 700. Here also, the designations with reference numbers are based on the designations of the first and second versions, and the following principal deviations from the examples described above are explained.

It must first be said that no protective or separating shield is drawn into this example, but one can be inserted on the underside of the irradiating apparatus, where it is held by metal springs. A further essential deviation consists of the fact that, here, the cooling air duct 703 on the upper side of the irradiating apparatus does not extend over its entire width, but is embedded in the housing's interior. Here, therefore, the lateral cooling air ducts with the reference numbers 704 and 706 extend up to the upper side of the irradiating apparatus. A further essential deviation is apparent in the shape of the rotating reflectors, which is rather more a V-shape here. The result of this modified shape is that the rotating reflector 725 has to be rotated by 180° on changeover between the operating and deactivated positions, whereas in the case of the previous versions, rotation by 60° suffices. This does not represent any practically relevant disadvantage, though.

One deviation from the versions described further above that is worthy of mention is also the modified structure of the reflectors consisting of one extruded or cast supporting element each and an inserted, reflection surface optimized in relation to the application. Thus, the rotating central reflector 725 has a supporting element 725.1 and a reflector surface 725.2 fitted onto it that is also approximately V-shaped. The auxiliary reflectors 717, 718, 719 and 720 also each have one supporting element (see further below) and a reflector surface 717.2, 718.2, 719.2 or 720.2 inserted in it.

Whereas the bottom auxiliary reflectors 718 and 720 are independent components with their own supporting element 718.1 or 720.1, in this version the top auxiliary reflectors 717 and 719 in the middle zone of the irradiating apparatus are linked to one another by means of a bridge, which also comprises the bottom boundary of the cooling air duct 703. Contrary to the versions previously described above, here there is no separate radiation absorber element but, instead, the middle portions of the auxiliary reflectors and the aforementioned (not separately marked) bridge act as a radiation absorber. This is why these portions do not have a reflector coating either.

With regard to cooling of the irradiating apparatus 700, it must be noted that the central rotating reflector 725 has a central cooling water duct 725*a* here and interior liquid cooling of the auxiliary reflectors analogously to this and is designed like in the second version. Cooling air can be forced through the lateral cooling ducts 704, 706 into the housing and then passes through the gap between the top and bottom auxiliary reflectors and between the UV radiation sources 713, 715 and the rotating reflector 725 further upwards in order to (not depicted) finally pass through openings into the large-volume central cooling air duct 703 and, through this, to finally leave the radiation unit in a highly heated state. If the optional protective shield is also used in this version, it makes sense to guide a part of the cooling air flow out of the lateral ducts 704, 706 at the sides of the bottom auxiliary reflectors 718, 720 to the inner side of the protective shield to also cool it.

As can be seen in FIG. 9 (where once again a series of reference numbers has been omitted, but these are not necessary for an explanation of the functions), for replacement of one of the UV radiation sources 713, 715 the neighboring side wall of the housing 701 (in FIG. 9 the left side wall 707) is tilted up and then the respective bottom auxiliary reflector (in FIG. 9 the left auxiliary reflector 718) is swiveled down so that the associated radiation source is adequately accessible.

This version of the invention is not limited to the examples and emphasized aspects described above, but is also possible in a large number of variants that lie within the scope of technical action. In particular, all technically expedient combinations of characteristics of the dependent claims and of the individual examples ought to be considered as belonging to the sphere of protection of the invention.

The invention claimed is:

1. An irradiating apparatus for technical use, comprising at least two radiation sources that emit processing radiation, at least one controllable reflector which is allocated to the at least two radiation sources and is used for selectively directing the processing radiation onto a substrate that is to be processed or away therefrom, a driving mechanism which is effectively connected to the at least one reflector and a housing that accommodates the at least two radiation sources and the at least one reflector, wherein one of the at least one reflectors is arranged between a first and second radiation source of the at least two radiation sources, and the one reflector is shaped and held in such a way that in a first position it guides the processing radiation of the first and second radiation sources towards the substrate and in a second position it guides the processing radiation of the first and second radiation sources away from the substrate.

2. The irradiating apparatus according to claim 1, where the radiation sources, the controllable reflector and the housing are stretched out in the form of a profile.

3. The irradiating apparatus according to claim 1 wherein precisely two radiation sources of the same type are arranged on both sides of a mirror-symmetrically arranged controllable reflector.

4. The irradiating apparatus according to claim 1 wherein the controllable reflector is rotatable between the first and second positions and the driving mechanism comprises one, electric motor or pneumatic rotary actuator.

5. The irradiating apparatus according to claim 2, wherein in the angle range around the radiation sources that is not taken up by the reflector surfaces of the controllable reflector, at least one stretched-out, auxiliary reflector is arranged respectively, which guides processing radiation essentially towards the controllable reflector.

6. The irradiating apparatus according to claim 5, wherein in the space portions above and below the first and second radiation sources there is one top and bottom auxiliary reflector respectively, which, in their cross-section, comprise a non-isosceles approximate U-shape.

7. The irradiating apparatus according to claim 2, where an end reflector portion is allocated to the ends of each radiation source.

8. The irradiating apparatus according to claim 1, wherein the controllable reflector and/or auxiliary reflectors and/or the end reflector portions each have at least one coolant duct to pass through a cooling fluid.

9. The irradiating apparatus according to claim 1, wherein the controllable reflector and/or the auxiliary reflectors and/or the end reflector portions comprise a curved reflector surface.

10. The irradiating apparatus according to claim 1 wherein the controllable reflector comprises a supporting element and at least one reflector surfaces inserted in it.

11. The irradiating apparatus according to claim 10, wherein a stationary auxiliary reflector is allocated to the one, or each, radiation source, the auxiliary reflector comprising at least one separably inserted reflector surface that essentially guides processing radiation towards the controllable reflector.

12. The irradiating apparatus according to claim 10, wherein the one, or each supporting element consists of an extruded or continuously east profile.

13. The irradiating apparatus according to claim 10, wherein the one, or each, support element consists of aluminium or an aluminium alloy.

14. The irradiating apparatus according to claim 10, where the one, or each, reflector surface is held by a latching or snap fastener in the supporting element.

15. The irradiating apparatus according to claim 1 wherein the controllable reflector is subdivided in the longitudinal direction, wherein at least one first and second part can be moved independently of one another in such a way that, during operation of the apparatus, optionally only one of them is in the first position, while the other is in the second position.

16. The irradiating apparatus according to claim 15, wherein between the first and second parts of the controllable reflector there is a driver acting independently of the direction of motion that drives the second part only in one direction of motion along with the first part, but does not drive it in the other direction of motion.

17. The irradiating apparatus according to claim 16, wherein the first and second parts are capable of rotating on a joint shaft and the driver acts depending on the direction of rotation.

18. The irradiating apparatus according to claim 15, wherein the first and second parts are held on a joint hollow shaft and can be driven separately via it or a separate power transmission element.

19. The irradiating apparatus according to claim 1, wherein to the one, or each, radiation source at least one auxiliary reflector is assigned, which particularly simultaneously constitutes a housing part, and which is capable of tilting or movement into a maintenance position so that the respective radiation source becomes accessible by tilting down or moving the auxiliary reflector.

20. The irradiating source according to claim 19, wherein the auxiliary reflector is designed and held so that the radiation source becomes accessible to an adequate extent for replacing it, by tilting it down or moving it.

21. The irradiating source according to claim 19 where two auxiliary reflectors are allocated to the one, or each, radiation source, each auxiliary reflector constituting a housing part and being capable of being tilted or moved and designed and held so that the radiation source becomes accessible to an adequate extent for its replacement by tilting it down or moving it.

22. The irradiating source according to claim 19, wherein the one, or each, auxiliary reflector capable of tilting or moving is held by a latching or snap fastener on a stationary housing part in the operating position.

23. The irradiating apparatus according to claim 1 wherein an actively cooled radiation absorber is arranged in that emission direction of the controllable reflector in which the processing radiation is guided away from the substrate.

24. The irradiating apparatus according to claim 23, wherein the radiation absorber comprises a coolant fluid duct whose surface pointing towards the controllable reflector has a high absorption capacity for the radiation of the radiation source(s).

25. The irradiating apparatus according to claim 24, wherein the coolant fluid duct of the radiation absorber is arranged and dimensioned as a cooling air duct.

26. The irradiating apparatus according to claim 1, wherein the one, or each, radiation source is forcibly cooled by cooling air blown into and/or sucked out of the housing.

27. The irradiating apparatus according to claim 25, wherein the cooling air duct of the radiation absorber has openings for an exchange of air with the space surrounding the radiation source(s).

28. The irradiating apparatus according to claim 1, wherein the one, or each, radiation source is a medium or high-pressure UV radiation source.

29. The irradiating apparatus according to claim 28, wherein the controllable reflect and/or auxiliary reflector have a high reflection coefficient in the UV range and a substantially lower reflection coefficient in the IR range.

30. The irradiating apparatus according to claim 29, wherein the surface of at least a part of the reflector surfaces pointing away from the radiation source and pointing towards the supporting element has a high IR emission capacity and/or is in good thermal conduction contact with the support element in such a way that a substantial part of arriving IR radiation components is dissipated into the respective reflector interior.

31. The irradiating apparatus according to claim 1, wherein the side pointing towards the substrate is essentially sealed by a protective shield that is permeable for the processing radiation, which is wavelength-selectively reflecting and/or absorbing.

32. The irradiating apparatus according to claim 31, wherein the protective shield has a low reflection and absorption coefficient in the UV range and a substantially higher reflection and/or absorption coefficient in the IR range.

33. Use of an irradiating apparatus according to claim 1 for drying ink, particularly in a rotary offset or sheet-fed offset press.

34. Use of an irradiating apparatus according to claim 1 in a lacquer or paint coating system.

35. An irradiating apparatus according to claim 1, used in a UV cross-linking apparatus of a printing press or coating machine.

36. An irradiating apparatus according to claim 1, wherein the at least one controllable reflector is a wavelength-selective reflector.

37. An irradiating apparatus according to claim 1, wherein the at least two radiation sources are capable of separate operation.

* * * * *